United States Patent [19]

Keller, Sr.

[11] Patent Number: 4,557,090

[45] Date of Patent: Dec. 10, 1985

[54] CURVILINEAR STRUCTURAL INSULATING PANEL AND METHOD OF MAKING THE SAME

[76] Inventor: Robert R. Keller, Sr., 10 Heritage Rd., Bedford, N.H. 03102

[21] Appl. No.: 540,013

[22] Filed: Oct. 7, 1983

[51] Int. Cl.[4] ..... E04C 2/34

[52] U.S. Cl. ..... 52/245; 52/80; 52/732; 52/785; 52/810

[58] Field of Search ..... 52/245, 80, 86, 236.2, 52/224, 404, 640, 644, 647, 474, 479, 720, 729, 732, 785, 788, 810, 741, 481

[56] References Cited

U.S. PATENT DOCUMENTS

| | | | |
|---|---|---|---|
| 2,981,382 | 4/1961 | Keller . | |
| 3,024,880 | 3/1962 | Burmeister . | |
| 3,405,495 | 10/1968 | Barbera | 52/479 X |
| 3,904,380 | 9/1975 | Smith | 52/732 X |
| 3,921,555 | 11/1975 | Suzuki et al. | 52/80 X |
| 4,004,429 | 1/1977 | Mouton | 52/80 X |
| 4,089,139 | 5/1978 | Moffa et al. | 52/245 X |
| 4,450,661 | 5/1984 | Whitener | 52/788 |

*Primary Examiner*—J. Karl Bell

*Attorney, Agent, or Firm*—Rines and Rines

[57] ABSTRACT

A curvilinear structural insulating panel that is comprised of a plurality of slotted beam members that are deformed to a preselected radius or radii of curvature, end beam members that connect to the slotted beam members at their ends and flexible sheets that connect to the beam members and provide a hollow, air filled panel, and a method for making the same.

19 Claims, 6 Drawing Figures

CURVILINEAR STRUCTURAL INSULATING PANEL AND METHOD OF MAKING THE SAME

The present invention relates to structural insulating panels, being more particularly directed to a structurally strong, thermally insulating panel taking the form of an arc of preselected size and radius, adapted for connection with surrounding similar curvilinear panels and a surrounding support structure.

In the accepted construction of insulating structures, rigid panels or bricks are secured along their edges to form planar insulating walls. Structures particularly useful for translucent and thermal insulating qualities are described, for example, in my prior U.S. Letters Pat. Nos. 2,981,382 and 3,024,880; most suitable for planar construction panels. Design considerations often suggest or require, however, the use of a non-planar insulating wall.

Present methods for simulating curved or non-planar insulating walls include securing planar panels or bricks such as hollow glass bricks and panels together with wedge shaped spacers (often mortar or presized spacers) to form a faceted approximate arc-segment, pseudo-curvilinear insulating wall. Such a faceted wall structure is not, however, truly a smooth curvilinear wall and requires the use of substantial fitted spacer materials that may lack the required insulating characteristics thereby making the entire wall structure less than an optimal insulator.

Presently, to form a truly curvilinear panel or wall of panels, rectilinear panels or bricks of insulating material, such as plastic insulating foams or foam-glass, are joined at their edges and the entire wall structure is cut, milled or ground to form a curvilinear wall surface. Alternatively, the panels or bricks are cut, milled or ground to have a curvilinear face and subsequently matched, fitted and joined to form a curvilinear wall structure. Both methods are unnecessarily complex and costly. Additionally, such a wall has numerous irregularities from the non-uniform cutting and fitting operations and the open cellular structure of the foamed materials. Although coatings of mastic or covering sheets can be secured to the surfaces of the wall, this requires an additional, expensive and non-insulating operation. Finally, due to the nature and construction of the materials being used, such cut-foam walls are generally opaque to light transmission and therefore inhibit radiational heating through the panel or wall of panels.

A third method of producing a structural insulating wall requires the standard construction of two walls that are separated by space, and the filling of that space by an insulating material, such as fiberglass or plastic foam. Such a wall is opaque to heat and light and susceptable to infestation by insects, rodents and other pests. Additionally, such a wall requires substantial construction and design skill to create a curvilinear wall of preselected arc and a separate operation to install and provide the insulating means.

The present invention provides a method for readily-producing structural insulating panels of preselected arcs of curvature that may be translucent or transparent to heat and light radiation, and can be easily joined to other panels to make a curvilinear structural insulating wall of preselected specification. It is therefore an object of the invention to provide a new and improved curvilinear structural insulating panel that is not subject to the limitations of prior panels and may be constructed in the form of an arc of preselected dimensions.

Another object is to provide a method of creating a panel that can be deformed to a preselected arc without bends or kinks in the materials and reduction in structural integrity.

A further object is to provide a novel panel that can be easily joined or connected to other similar panels to form a curvilinear structural insulating wall; and one that provides a structural insulating panel that is easily reproducable.

A still further object is to provide a novel panel that inhibits pest infestation during use.

Other and further objects will be explained hereinafter and are more particulalry delineated in the appended claims.

In summary, from one of its aspects, the invention embraces an insulating curvilinear panel structure having, in combination, a panel frame bounding a portion of a curve and formed by a pair of spaced similarly curved I-beam members joined between their ends by a pair of straight I-beam members; each curved I-beam member being formed by a pair of oppositely directed similarly curved T-shaped beam members having the long portions of the T's slotted into tabs and overlapped and joined together with the slots of each of the pair of T-shaped beam members deformed to accomodate the curve and staggered with respect to the slots of the other of the pair along the arc of their curve; and insulating cover sheet materials formed as a curvilinear outer and inner coaxial surfaces adhered to the corresponding outer and inner cross portions of the I-beams that serve as load-bearing edge surfaces of opposite sides of the frames.

Preferred details and method of construction are hereinafter explained.

The invention will now be described with reference to the accompanying drawings, FIG. 1 of which is an elevated perspective view of a preferred embodiment of the invention with a portion cut away to show detail;

Figure 1:
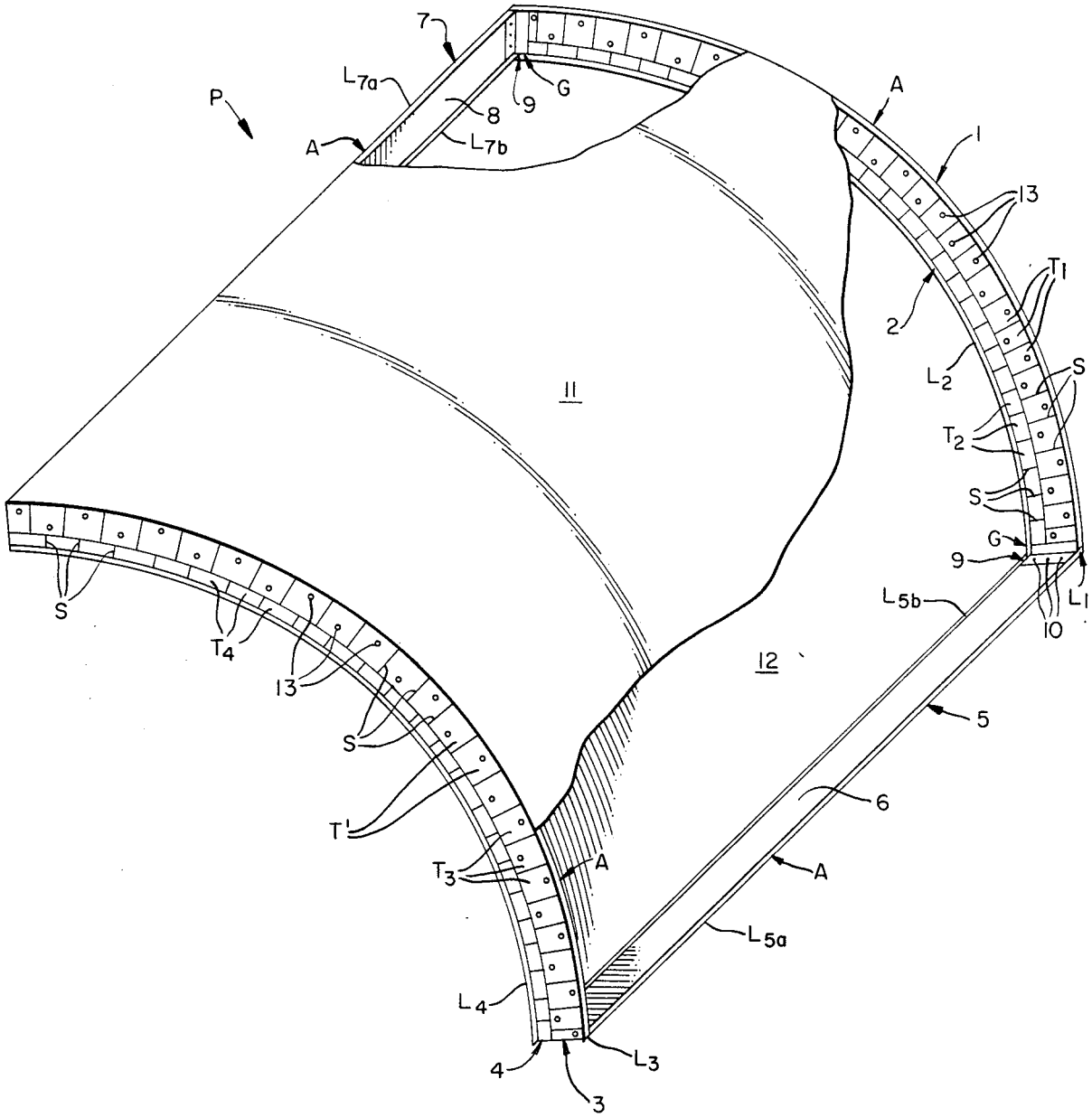

Referring now to FIG. 1, the letter P refers to a curvilinear structural insulating panel made in accordance with the present invention having curved I-beam members formed of pairs of oppositely mounted parallel T-beams 1, 2, and 3, and 4, each having a series of successive tabs $T_1$, $T_2$, and $T_3$, and $T_4$, respectively, comprising the long portions of the "T" and successively separated by slots S as will be discussed in more detail hereinafter. In the formation of a panel P, beam members 1 and 3 are bent such that the load bearing cross portions $L_1$ and $L_3$, respectively, of the beams 1 and 3 extend along the outer radius of curvature of the panel P, with the tabs $T_1$ and $T_3$ extending inwardly towards the center of the radius of curvature. T-beam members 2 and 4 are disposed oppositely to respective T-beam members 1 and 3 and are similarly curvedly bent such that the load bearing cross portions of the "T", $L_2$ and $L_4$, respectively, of the beams 2 and 4 extend along the inner radius of curvature of the panel P, with the tabs $T_2$ and $T_4$ extending outwardly (upwardly in FIG. 1 from the radius of curvature. When the beams 1 and 3 are curvedly similarly bent, the tabs $T_1$ and $T_3$ are curvedly deformed and are forced into closer proximity in direct proportion to the radius of curvature of the panel P and the distance from the load bearing portions $L_1$ and $L_3$; but not close enough to require overlapping or contact of any portion of the respective tabs $T_1$ and $T_3$. Additionally, when the T-beams 2 and 4 are thus bent, the tabs $T_2$ and $T_4$ are curvedly deformed in direct proportion to the radius or radii of curvature of the panel P and distance from the load bearing portions $L_2$ and $L_4$. Further discussion of the slot forms and tab positions will be detailed in reference to FIGS. 2 and 3 hereinafter.

Figure 3:
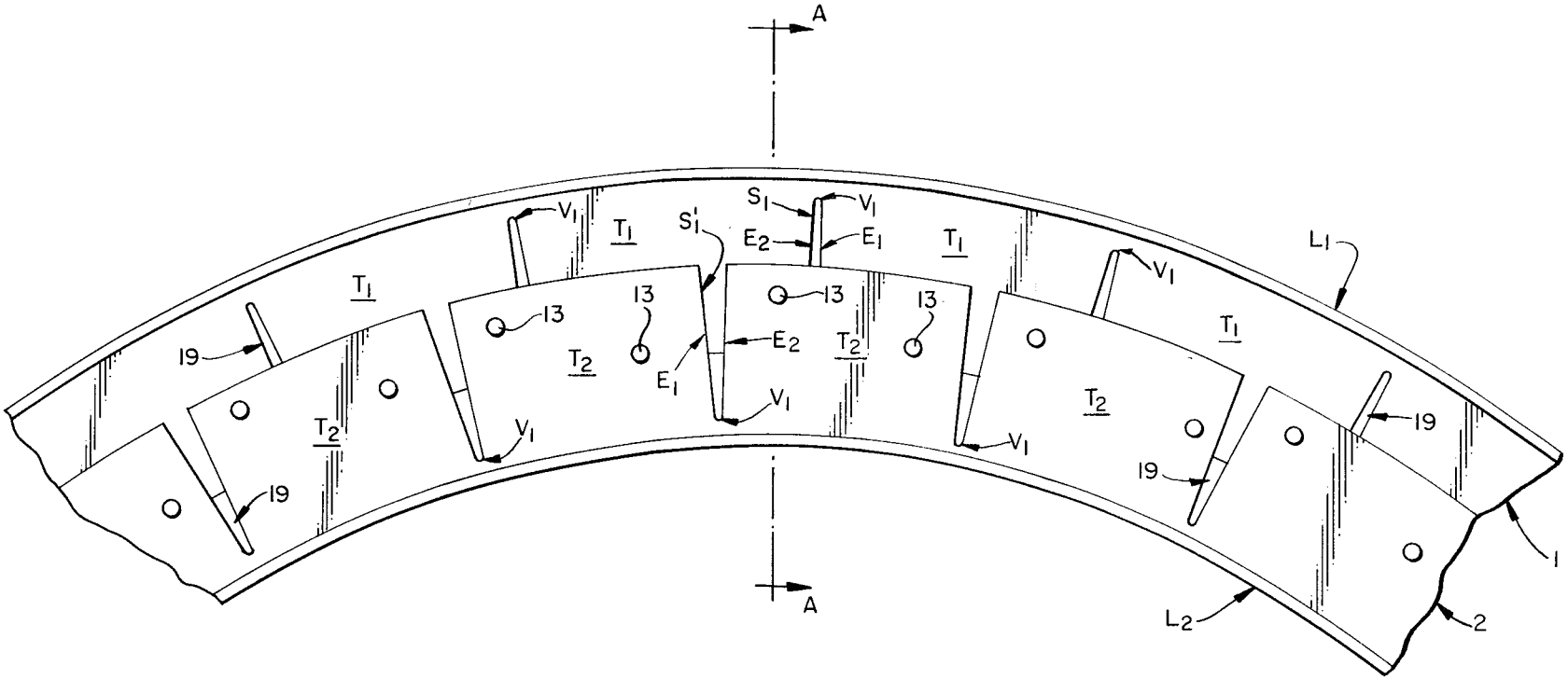
FIG. 3 is an elevated side view of a pair of curved T-beam member sections joined to form a composite curved I-beam for the panel frame in accordance with a preferred embodiment of the invention.

After the beam members 1–4 have been bent to the desired radius of curvature or arc, the oppositely directed pair of T-beams 1 and 2 are rigidly secured together, such as by clinches 13, drawn through the tab $T_1$ and into the tab $T_2$ as shown in FIG. 3, such that all points along the load bearing portions $L_1$ and $L_2$ are equidistant from each other, forming a pair of curvilinear parallel load bearing portions $L_1$ and $L_2$. Other means for securing the beam tabs together are contemplated, including a threaded bolt and mated nut arrangement, rivets, adhesives, and swedges between the tabs (where a portion of both tabs to be joined is punched through and folded over one of the tabs) to secure the beams in a parallel load bearing portion arrangement. The general overlapped tab arrangement, however secured, provides, in effect, a curvilinear I-beam configuration with all of the structural strength and rigidity inherent in such a structure. Additionally, the tabs T cover all but a small portion of the slots S, designated by the number 19 in FIG. 3, which inhibits vermin from entering and infesting the panel, while allowing sufficient controlled air convection though the panel to avoid bursting under elevated temperature gas-expansive conditions and limiting the convection and vapor condensation within the panel to provide optimal thermal insulating characteristics. The T-beams 3 and 4 are similarly secured together to form a pair of curvilinear parallel load bearing portions $L_3$ and $L_4$.

Figure 4:
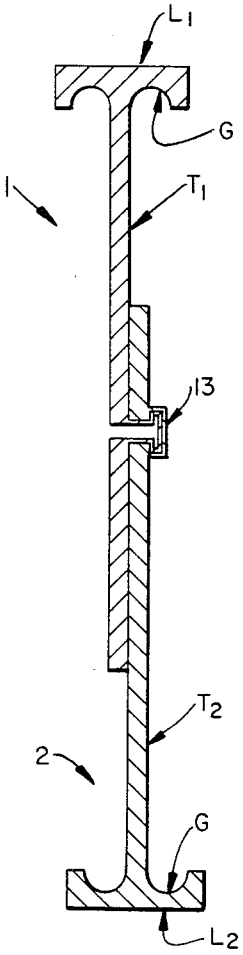
FIG. 4 is an enlarged transverse section, taken along the line A—A of FIG. 3, showing the connection of the T-beams to form a curved I-beam.

End beam members, such as straight or linear I-beams 5 and 7 (FIG. 1) with load bearing portions $L_{5a}$, $L_{5b}$ and $L_{7a}$, $L_{7b}$ and spacer portions 6 and 8, respectively, are attached to the ends of the curvilinear beam members 1–4 to form a cylindrical frame, as by a bracket, such as L-bracket 9, and attached to the beams 5 and 7 by securing means, such as rivets 10. The non-riveted portion of the L-bracket 9 is then inserted into the grooves G of the pairs of beams 1–2 and 3–4. With the L-bracket 9 inserted into the grooves G a structurally rigid attachment is formed, as seen in FIGS. 1 and 4. lhe beams are attached such that the load bearing portions $L_1$ and $L_3$ are flush with $L_{5a}$ and $L_{7a}$ and the load bearing portions $L_2$ and $L_4$ are flush with $L_{5b}$ and $L_{7b}$, respectively so that the frame of the panel comprises a pair of similarly curved I-beam members formed by the pairs of oppositely mounted T-beam members 1, 2 and 3, 4, joined at corresponding ends by straight I-beam members 5 and 7 to form a curved arc of a cylinder. Attachment in this manner provides in the panel frame a smooth upper load bearing surface formed by the edge strips $L_1$, $L_3$, $L_{5a}$ and $L_{7a}$ and a smooth lower load bearing surface formed by $L_2$, $L_4$ , $L_{5b}$ and $L_{7b}$, respectively defining spaced coaxial cylindrical surfaces for receiving cover sheets.

Adhesive or bonding material (schematically illustrated at A), such as epoxy resins, hot melt adhesives, or other customary permanent adhesives that will adhere or bond non-similar materials together, may be applied to the said edge strips that provide upper and lower or spaced coaxial load bearing surfaces of the frame noted above. Alternatively, the adhesive or bonding material may be applied to the load bearing surfaces of the beams prior to panel construction.

After the adhesive or bonding material has been applied to the outer and inner frame edge strip load bearing surfaces of the beams, a pair of flexible covering sheets of material, such as fiberglass-resin sheets 11 and 12, are adhered to the frame edge strips, as shown in FIG. 1, such that flexible sheet 11 contacts all portions of the outer frame edge strip load bearing surfaces $L_1$, $L_3$, $L_{5a}$, and $L_{7a}$ and the flexible sheet 12 contacts all portions of the inner frame edges strip load bearing surfaces $L_2$, $L_4$, $L_{5b}$ and $L_{7b}$. The sheet surfaces 11 and 12 are then coaxial parallel cylindrical outer and inner surface spaced by the panel frame. The flexible sheets 11 and 12 are preferably translucent or transparent sheets of limited thermal conductivity, capable of being bent and secured in curvilinear (including cylindrical) form while retaining structural integrity. Translucent sheets generally are used to insulate against heat loss where some thermal radiation is present and can penetrate the panel to provide a warming of the air within and on the other side of the panel, as a green house effect, while the limited conduction of heat through the panel provides an optimum barrier against heat loss through the panel. Prevention of gross circulation of external air can be achieved, where desired, by tape-sealing or otherwise blocking the slotted tab surfaces T along their surface at T', FIG. 1. Materials such as fiberglass-resin sheets or other plastic or resin composite sheets, plexiglass or plastic sheets are contemplated for the surfaces 11 and 12, though opaque materials may for some purposes also be acceptable. Additionally, it is desirable that the adhesive or bonding material be semi-flexible to absorb or compensate for the thermal and other stresses produced between the sheets 11 and 12 and the load bearing frame edge portions of the beams 1–4, 5 and 7.

Alternatively, in some applications, the sheets 11 and 12 may be adhered to the load bearing surfaces by mechanical attachment, such as by screws, rivets, or nuts and bolts with or without a mastic material between the sheets and the load bearing portions of the beams. Such a mechanical attachment might be used where the flexible sheet material displays sufficient structural integrity and the environment for the panel P precludes the use of standard adhesives.

Figure 2:
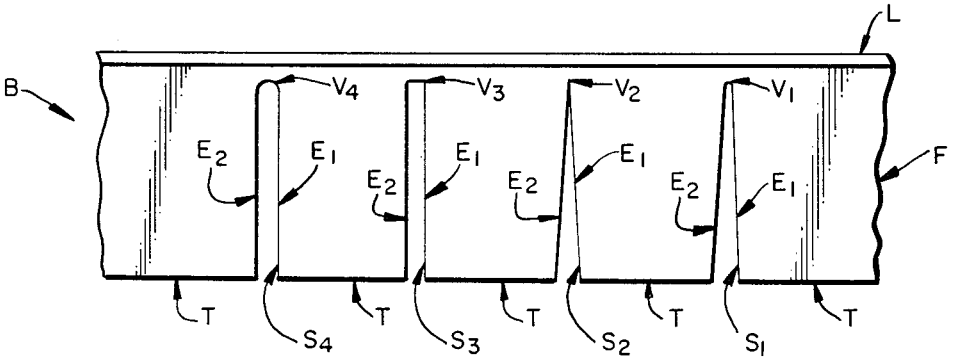
FIG. 2 is an elevated side view of a beam member section displaying differing types of transverse slots.

Referring now to FIG. 2, a T-beam B, such as the beams 1 to 4, is normally composed of a load bearing cross portion of the T, designated L, connected intermediately at right angles to the longer portion of the T, shown as a spacer or fin material portion F. In accordance with the present invention, the fin material F is slotted at specified intervals and at right angles to the load bearing portion L of the T-beam B with one or more types of slots S to form a series of tabs T. The slots S can be cut, milled, ground or punched out of the fin material F, or the fin material F may be constructed with the slots S formed therewith. FIG. 2 diagramatically and illustratively shows some of the different slot configurations that may be employed. The slots S can take many forms, but all commonly have a generally elongated configuration, that is that the length of the slot is greater than the width of the slot, where each slot has a first edge $E_1$ and a second edge $E_2$ that are joined near the load bearing portion L of the beam B by a vertex V. The preferred form of slot contemplated is the rounded V-slot, designated at $S_1$, which has its converging edges $E_1$ and $E_2$ linearly approaching in direct proportion to the distance from the vertex $V_1$, and a vertex $V_1$ that is rounded to avoid the providing of a fracture point when the beam B is bent. Other slot types include the V-slot $S_2$ with sharp vertex $V_2$, the rectangular slot with flat termination $V_3$ at $S_3$, and the rounded vertex $V_4$ of rectangular slot $S_4$.

After the slots and tabs are formed in the individual T-beams 1 to 4, the beams are bent to the preselected arc of curvature desired for the panel, as by pressing around a preformed mandril (not shown), such that the beam material permanently deforms to the shape of the mandril and assumes the preselected arc of curvature. The beam material must have sufficient ductability to allow reasonable bending without fracture and without loss of structural integrity. A T-bar or T-beam of structural aluminum, provides such a T-beam that is capable of being bent over a mandril by normal human strength without fracturing and that will hold the curved configuration. During the deformation process, the beams must be bent so as to produce a smooth arc of curvature that is free of kinks, sharp bends, cracks and fractures in the material.

The size and shape of the tabs T and slots S are critical in the formation of a properly formed curvilinear beam. Using the structural aluminum T-beam and a rounded V-slot, as designated in FIG. 2 at $S_1$, a tab of length approximately 1.834 inches measured from the edge furthest from the load bearing portion L of the beam B to the underside of the head portion of the beam B that includes the load bearing portion L, has been found most satisfactory. Additionally, the tab may have a thickness of approximately 0.040 inches and a width at its narrowest portion (furthest from the load bearing portion) based on the following chart:

| Radius of Curvature (in inches) | Tab Width (in inches) |
|---|---|
| 18–30 | ½ |
| 31–36 | ¾ |
| 37–72 | 1 |
| 73–108 | 2 |
| 109–132 | 3 |
| 133–156 | 4 |
| 157–216 | 5 |
| 216+ | 6 |

The cross portion of the T-beam member serving as a load-bearing portion may be approximately 0.438 inches wide with a 0.041 inch thick head portion and a 0.094 inch recurved lip portions which form the grooves G, FIG. 1, more clearly shown in later-described FIGS. 4 and 5. When the panel is assembled, the slot is approximately 0.200 inches wide at the point furthest from the vertex and its edges taper in to approximately 0.090 inches at the vertex, which is a semi-circular portion with a radius of curvature of approximately 0.045 inches. The vertex gains proximity to as close as approximately 0.229 inches from the load bearing surface L of the head of the T-beam.

A panel constructed in accordance with this embodiment may be formed in any arc or series of arcs from a radius or radii of curvature of, for example, a foot and a half up to a straight curvilinear panel (radius infinite) and including complex curves, such as "S" curves and parabolas, by proper tab and slot sizes. Using differing materials and construction, curvilinear (including cylindrical) panels of smaller radii of curvature are possible in a similar manner. Additionally, a single beam may be formed into an arc portion of length greater than one-half of the arc of the circle, subject only to the mechanical requirements of the mandril or other curve forming operation and devices.

The curved T-beam 1 is shown connected to the oppositely oriented parallel curved T-beam 2 in FIG. 3, wherein the beam 1 is the outer and the beam 2 the inner of a composite curved I-beam formed by the pair of oppositely positioned T-beams 1 and 2. The slotted tab or long portions $T_1$ of the T-beam 1 are shown overlapped with the slotted tab or long portions $T_2$ of the T-beam 2, with their respective deformed slots $S_1$ and $S_1'$ staggered along the arc and clinched at 13, preferably at alternative higher and lower spots, as shown.

Figure 5:
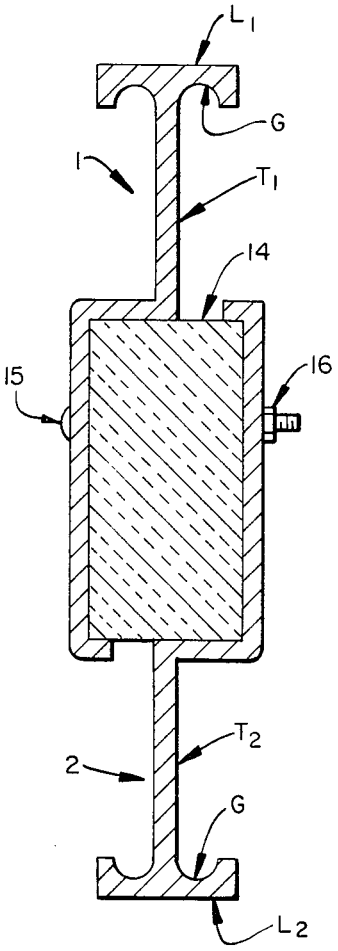
FIG. 5 is a view similar to FIG. 4 showing a modification.

Referring now to FIGS. 4 and 5, FIG. 4 represents a standard tab-overlapped and clinched beam arrangement where the tabs $T_1$ of the first beam 1 are secured to the tabs $T_2$ of the second oppositely oriented T-beam 2 by a clinch 13, as previously described, with the respective slots staggered along the curve, as more particularly shown in FIG. 3. FIG. 5 represents a similar arrangement, wherein the tabs $T_1$ and $T_2$ are deformed partially to surround a thermally insulating spacer material, such as a plastic foam strip 14. The tabs $T_1$ and $T_2$ are secured in a generally spaced parallel relationship and abutting the strip 14, by threaded bolt 15 and mated nut 16. Even though the arrangement of the beams, as in FIG. 4, in comparison with the size of the panel, with a large body of trapped, thermally insulating air, provides minimal thermal conductance through the panel, the use of an insulating spacer material, such as strip 14 shown in FIG. 5 reduces even further the thermal conductivity through the panel by the connected beam materials due to the thermally separated conductive material.

Figure 6:
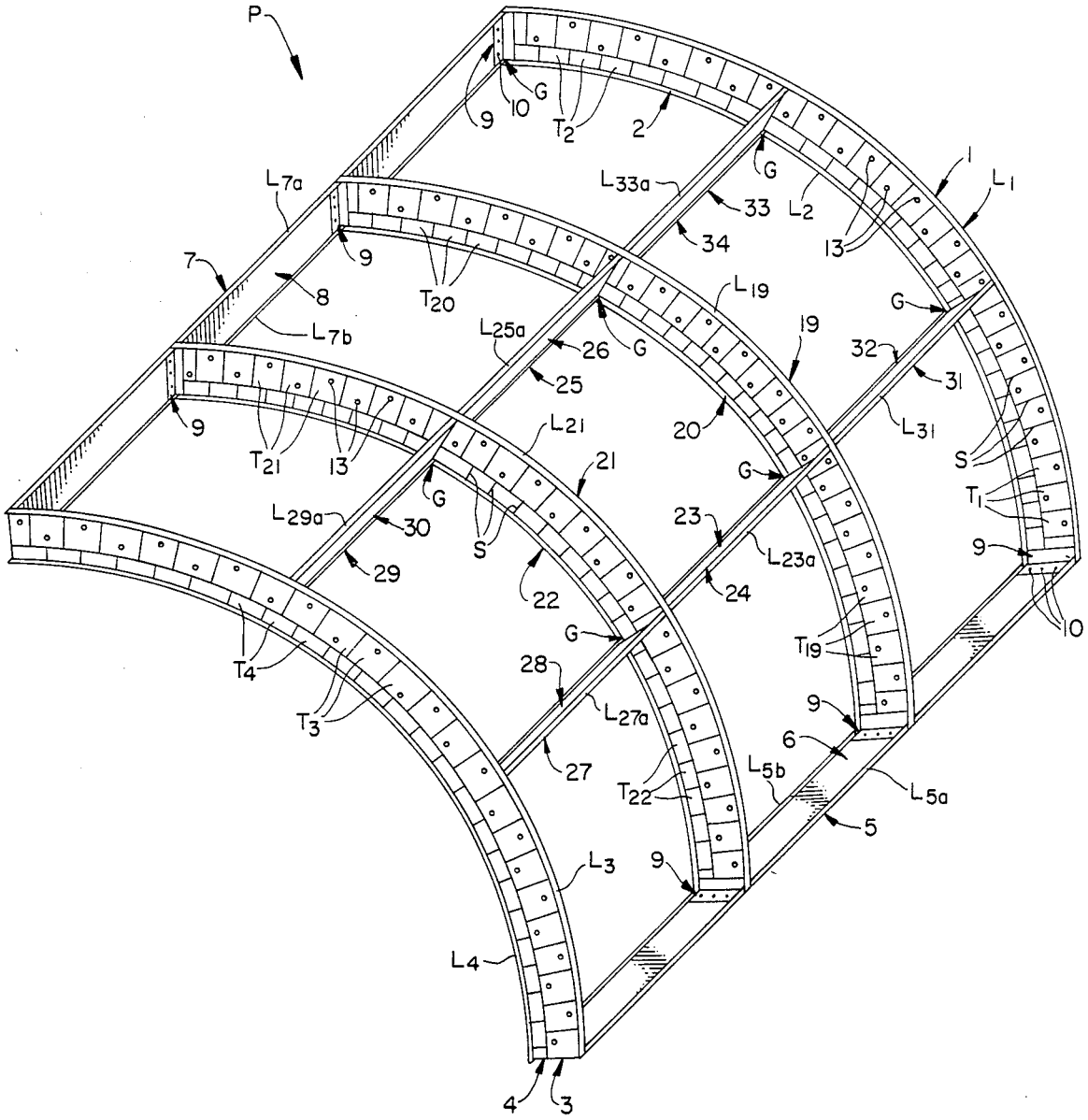
FIG. 6 is a view similar to FIG. 1 showing a panel with additional supporting internal beam members, with the outer cover sheets omitted to show constructional detail.

Referring now to FIG. 6, the letter P again refers to the complex coaxial surface cylindrical insulating panel of the general type illustrated in FIG. 1, wherein like numbers designate like parts. To provide additional structural integrity to the panel P and better to support the plastic sheets 11 and 12 of FIG. 1, additional beam members may be intermediately secured to the original frame beams 1–4, 5 and 7. Specifically, intermediately disposed curvilinear beam members 19 and 21 may be secured to curvilinear beam members 20 and 22, respectively, in a manner similar to that previously described in connection with beams 1 and 2, and each beam member may be frictionally secured at its ends to the linear end beam members 5 and 7 by L-brackets 9, also as previously described. Preferably, the beams 1–4 and 19–22 are connected to the linear end beam members 5 and 7 intermediate the frame in mutually parallel arrangement, such that the distance from one joined pair of beams 1–2, 3–4, 19–20, or 21–22 to its neighboring joined pair is the same for any pair of joined beams. For example, the distance between joined beams 19–20 and beams 21–22 is shown substantially the same as from beams 19–20 to beams 1–2.

The curvilinear beams 1–4 and 19–22 are additionally supported by a series of straight or linear crossbars, such as I-beams 23, 25, 27, 29, 31 and 33, in parallel relationship to the end beams 5 and 7 and joined at right angles to the curvilinear beams 1–4 and 19–22 such as by frictional engagement to the grooves G of the beams. Each I-beam 23, 25, 27, 29, 31 and 33 has a first load bearing portion $L_{23a}$, $L_{25a}$, $L_{27a}$, $L_{29a}$, $L_{31a}$, and $L_{33a}$, respectively, and a second load bearing portion (not shown) separated by a spacer portion 24, 26, 28, 30, 32 and 34 respectively. Each crossbar I-beam connects two joined pairs of curvilinear beam members along their length to provide greater structural rigidity. Therefore, when the plastic sheets (shown in FIG. 1 as 11 and 12) are adhered to the panel P, the sheet 11 is adhered to the frame strip load bearing portions $L_1$, $L_2$, $L_{5a}$, $L_{7a}$, $L_{19}$, $L_{21}$, $L_{23a}$, $L_{25a}$, $L_{17a}$, $L_{29a}$, $L_{31a}$, and $L_{33a}$ and the sheet 12 is adhered to the load bearing portions $L_2$, $L_4$, $L_{5b}$, $L_{7b}$, the load bearing portions of beams 20 and 22 and the opposite load bearing portion of the crossbar I-beams 23, 25, 27, 29, 31 and 33. Such a configuration provides substantial internal support for the plastic sheets and further limits the thermal convection through the panel (controlled by the size and number of tab slots) and further inhibits the ability of pest infestation of the panel.

Finally, as the panels are easily duplicated and have known, reproducable dimensions, since the beam 1 is bent around a pre-formed mandril before joining, frames can be produced to easily hold the finished panels. Additionally, since each panel has essentially flat edges that are at right angles to the arc of the preselected curve of the panel, multiple panels of the same radius of curvature can be joined without angled or wedged fittings. Alternatively, a joining clamp assembly may be used as described in my earlier U.S. Letters Pat. No. 4,129,973.

Further modifications will also occur to those skilled in this art, and such are considered to fall within the spirit and scope of the invention as defined in the appended claims.

What is claimed is:

1. An insulating curvilinear panel structure having, in combination, a panel frame bounding a portion of a curve and formed by a pair of spaced similarly curved I-beam members joined between their ends by a pair of straight I-beam members; each curved I-beam member being formed by a pair of oppositely directed similarly curved T-shaped beam members having the long portion of the T's slotted into tabs and overlapped and joined together with the slots of each of the pair of T-shaped beams members deformed to accomodate the curve and staggered with respect to the slots of the other of the pair along the arc of their curve; and insulating cover sheet material formed as curved outer and inner coaxial surfaces adhered to the corresponding outer and inner cross portions of the I-beams that serve as load-bearing edge surfaces of opposite sides of the frames.

2. An insulating curvilinear panel structure as claimed in claim 1 and in which said insulating cover sheets are light-transmitting.

3. An insulating curvilinear panel structure as claimed in claim 1 and in which the air within the frame between the outer and inner coaxial cover sheets is controlled by the leakage provided by said slots.

4. An insulating curvilinear panel structure as claimed in claim 3 and in which the said tabs are covered with a sealing layer.

5. An insulating curvilinear panel structure as claimed in claim 1 and in which one or more additional curved I-beams with perpendicularly intersecting straight I-beams are provided within the frame and with their cross portions also adhered to the cover sheets to provide additional panel strength.

6. A curvilinear structural insulating panel having, in combination, four substantially equal length beam members, each having a longitudinally extending peripheral portion divided into tabs by transverse slots, each beam describing a curve of a preselected arc such that the load-bearing portions of the first beam and the third beam extend along the outer radius of the curve with the tabs extending inwardly and the load-bearing portions of the second beam and the fourth beam extend along the inner radius of the curve with the tabs extending outwardly; joining means for rigidly securing the tabs of the first beam in close parallel relationship to the second beam and the tabs of the third beam in close parallel relationship to the fourth beam such that the load-bearing portion of the first beam is parallel to the load-bearing portion of the second beam and the load-bearing portion of the third beam is parallel to the load-bearing portion of the fourth beam; two equal length linear end beam members, each with load-bearing portions in spaced parallel relationship connected by a longitudinally extending wall portion between the load-bearing portions having a width such that the distance between the load-bearing portions of the linear end beam members is essentially equal to the distance between the load-bearing portion of the first and second beam members and the third and fourth beam members, respectively; attachment means for rigidly securing the first linear end beam member to one end of the four curved beam members and for securing the second linear end beam member to the opposite end of the four curved beam members, such that the load-bearing portions of the first and third beam members are flush with one load-bearing portion of both linear end beam members and the load-bearing portions of the second and fourth beam members are flush with the other load-bearing poriton of both linear end beam members; two flexible sheets with a length dimension greater than or equal to the distance of arc between the two linear end beam members and with a width dimension greater than or equal to the distance between the load-bearing portions of the first and third beam members and the second and fourth beam members; and adhesive means to secure the first flexible sheet to the flush load-bearing portions of the first and third beam members and one load-bearing portion of both end beam members and to secure the second flexible sheet to the flush load-bearing portions of the second and fourth beam members and the other load-bearing portion both of the end beam members.

7. A panel as claimed in claim 6, and in which the tabs in the beam members are formed by V-shaped transverse slots with the Vertex of the slot closest to the load-bearing portion of the beam.

8. A panel is claimed in claim 7, and in which the beam members are made of metal and the flexible sheets are of plastic.

9. A panel as claimed in claim 8, and in which the flexible sheets are translucent.

10. A panel as claimed in claim 6 and in which the four substantially equal length beam members are connected pairs of oppositely directed T-beams.

11. A panel as claimed in claim 6 and in which the two equal length linear end beam members are I-beams.

12. A panel as claimed in claim 6 and in which the tabs of the first beam are secured to the tabs of the second beam and the tabs of the third beam are secured to the tabs of the fourth beam.

13. A panel as claimed in claim 12 and in which a spacer material is secured between the tabs of first beam and the tabs of the second beam and between the tabs of the third beam and the tabs of the fourth beam.

14. A panel as claimed in claim 13 and in which the spacer material is made from a thermally insulating material.

15. A panel as claimed in claim 6 and in which the slots are of a size sufficient to control air convection through the panel.

16. A panel as claimed in claim 6 and in which the slots are of a size sufficient to control vapor condensation within the panel.

17. A panel as claimed in claim 6 and in which the slots are of a size sufficient to inhibit the infestation of pests in the panel.

18. A method of forming a curvilinear structural insulating panel that comprises cutting transverse slots into the longitudinally extending peripheral portions of four substantially equal length T-beams to form tabs in the non-load-bearing portions of the T-beams; bending the beams to create a curve of a preselected arc, without kinks, breaks, or sharp bends in the beams, such that the load-bearing portions of the first beam and the third beam extend along the outer radius of the curve with the tabs extending inwardly and the load bearing portions of the second beam and fourth beam extending along the inner radius of the curve with the tabs extending outwardly; securing the tabs of the first beam and the second beam together and the third beam and the fourth beam together such that the load-bearing portion of the first beam is parallel to the load-bearing portion of the second beam and the load-bearing portion of the third beam is parallel to the load bearing portion of the fourth beam; attaching two equal length I-beam end members to opposite ends of the four beams such that the load-bearing portions of each I-beam are secured to and flush with one end of the load bearing portions of the four beams; adhering two flexible sheets to the beam members such that each sheet is adhered to one set of flush load-bearing surfaces formed by two T-beam members that are not connected by tabs and two I-beam end members.

19. A method as claimed in claim 18 and in which a layer of thermally insulating material is positioned between the tabs of the first beam and the second beam and between the tabs of the third beam and the fourth beam such that, when the tabs of the respective beams are secured together, the tabs are separated by the layer of insulating material.

* * * * *